US006145254A

United States Patent [19]

Silva

[11] Patent Number: 6,145,254

[45] Date of Patent: Nov. 14, 2000

[54] RETRACTABLE ROOF PANEL

[76] Inventor: Maria Leticia Silva, 17466 E. Monning Ave., Reedley, Calif. 93654

[21] Appl. No.: 09/186,254

[22] Filed: Nov. 5, 1998

[51] Int. Cl.[7] ..... E04B 7/16

[52] U.S. Cl. ..... 52/66; 52/72

[58] Field of Search ..... 52/66, 72, 64

[56] References Cited

U.S. PATENT DOCUMENTS 2,229,908 1/1941 Wenneborg ..... 52/66
5,257,481 11/1993 Reppas et al. ..... 52/66

FOREIGN PATENT DOCUMENTS 2642802 3/1978 Germany ..... 52/72

*Primary Examiner*—Michael Safavi

[57] ABSTRACT

A retractable roof panel for selectively permitting light and air to enter through an opening in the roof. The retractable roof panel includes a pair of opposed side rails that are coupled to an upper surface of the roof structure and extend along the side edges adjacent the opening of the roof structure. A panel member has a pair of opposed panel sides, an upper end and a lower end and is slidably disposed between the side rails. The panel member is positionable between a closed position and an open position. The panel member substantially closes the opening of the roof structure when in the closed position. The opening of the roof structure is substantially open when the panel member is in the closed position.

19 Claims, 3 Drawing Sheets

RETRACTABLE ROOF PANEL

BACKGROUND OF THE INVENTION

1. Field of the Invention

The present invention relates to retractable roofing structures and more particularly pertains to a new retractable roof panel for selectively permitting light and air to enter through an opening in the roof.

2. Description of the Prior Art

The use of retractable roofing structures is known in the prior art. More specifically, retractable roofing structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,727,688; U.S. Pat. No. 2,335,708; U.S. Pat. No. 5,655,335; U.S. Pat. No. 5,596,844; U.S. Pat. No. 2,090,827; and U.S. Pat. No. 1,710,118.

While these devices fulfill their respective, particular objectives and requirements, the aforementioned patents do not disclose a new retractable roof panel. The inventive device includes a pair of opposed side rails that are coupled to an upper surface of the roof structure and extend along the side edges adjacent the opening of the roof structure. A panel member has a pair of opposed panel sides, an upper end and a lower end and is slidably disposed between the side rails. The panel member is positionable between a closed position and an open position. The panel member substantially closes the opening of the roof structure when in the closed position. The opening of the roof structure is substantially open when the panel member is in the closed position.

In these respects, the retractable roof panel according to the present invention substantially departs from the conventional concepts and designs of the prior art, and in so doing provides an apparatus primarily developed for the purpose of selectively permitting light and air to enter through an opening in the roof.

SUMMARY OF THE INVENTION

In view of the foregoing disadvantages inherent in the known types of retractable roofing structures now present in the prior art, the present invention provides a new retractable roof panel construction wherein the same can be utilized for selectively permitting light and air to enter through an opening in the roof.

The general purpose of the present invention, which will be described subsequently in greater detail, is to provide a new retractable roof panel apparatus and method which has many of the advantages of the retractable roofing structures mentioned heretofore and many novel features that result in a new retractable roof panel which is not anticipated, rendered obvious, suggested, or even implied by any of the prior art retractable roofing structures, either alone or in any combination thereof.

To attain this, the present invention generally comprises a pair of opposed side rails that are coupled to an upper surface of the roof surface and extend along the side edges adjacent the opening of the roof structure. A panel member has a pair of opposed panel sides, an upper end and a lower end and is slidably disposed between the side rails. The panel member is positionable between a closed position and an open position. The panel member substantially closes the opening of the roof structure when in the closed position. The opening of the roof structure is substantially open when the panel member is in the closed position.

There has thus been outlined, rather broadly, the more important features of the invention in order that the detailed description thereof that follows may be better understood, and in order that the present invention to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new retractable roof panel apparatus and method which has many of the advantages of the retractable roofing structures mentioned heretofore and many novel features that result in a new retractable roof panel which is not anticipated, rendered obvious, suggested, or even implied by any of the prior art retractable roofing structures, either alone or in any combination thereof.

It is another object of the present invention to provide a new retractable roof panel which may be easily and efficiently manufactured and marketed.

It is a further object of the present invention to provide a new retractable roof panel which is of a durable and reliable construction.

An even further object of the present invention is to provide a new retractable roof panel which is susceptible of a low cost of manufacture with regard to both materials and labor, and which accordingly is then susceptible of low prices of sale to the consuming public, thereby making such retractable roof panel economically available to the buying public.

Still yet another object of the present invention is to provide a new retractable roof panel which provides in the apparatuses and methods of the prior art some of the advantages thereof, while simultaneously overcoming some of the disadvantages normally associated therewith.

Still another object of the present invention is to provide a new retractable roof panel for selectively permitting light and air to enter through an opening in the roof.

Yet another object of the present invention is to provide a new retractable roof panel which includes a pair of opposed side rails that are coupled to an upper surface of the roof structure and extend along the side edges adjacent the opening of the roof structure. A panel member has a pair of opposed panel sides, an upper end and a lower end and is slidably disposed between the side rails. The panel member is positionable between a closed position and an open position. The panel member substantially closes the opening of the roof structure when in the closed position. The opening of the roof structure is substantially open when the panel member is in the closed position.

Still yet another object of the present invention is to provide a new retractable roof panel that promotes vitamin D production in the skin by permitting sunlight to enter into a home.

Even still another object of the present invention is to provide a new retractable roof panel that may be used on a screened porch to cover the porch in rain and open it in sun.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
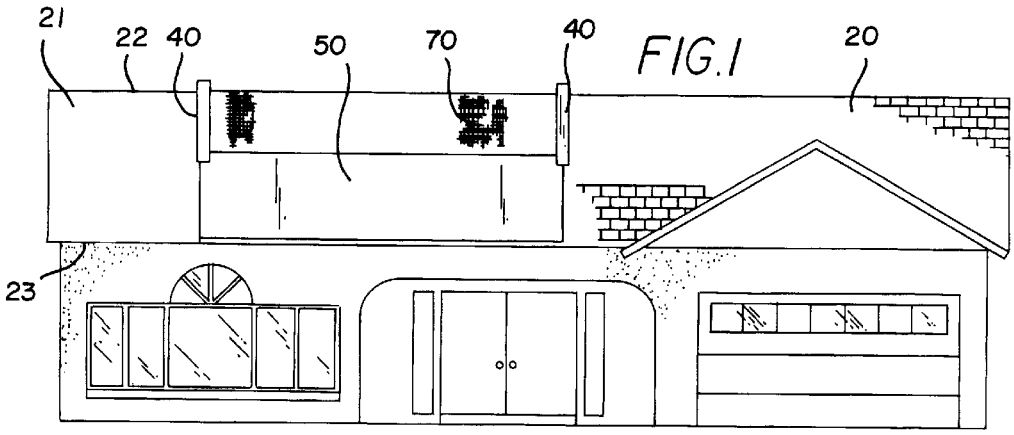
FIG. 1 is a schematic side view of a new retractable roof panel according to the present invention.

With reference now to the drawings, and in particular to FIGS. 1 through 6 thereof, a new retractable roof panel embodying the principles and concepts of the present invention and generally designated by the reference numeral 10 will be described.

As best illustrated in FIGS. 1 through 6, the retractable roof panel 10 is adapted for mounting to a roof structure 20 that has a generally rectangular opening 26, and a pair of opposite side edges (not shown) and upper and lower edges 25 that define the opening 26. The retractable roof panel 10 generally comprises a pair of opposed side rails 40 that are coupled to an upper surface of the roof structure 20 and extend along the side edges (not shown) adjacent the opening 26 of the roof structure 20. A panel member 50 has a pair of opposed panel sides 51, an upper end 52 and a lower end 53 and is slidably disposed between the side rails 40. The panel member 50 is positionable between a closed position and an open position. The panel member 50 substantially closes the opening 26 of the roof structure 20 when in the closed position. The opening 26 of the roof structure 20 is substantially open when the panel member 50 is in the closed position.

Figure 3:
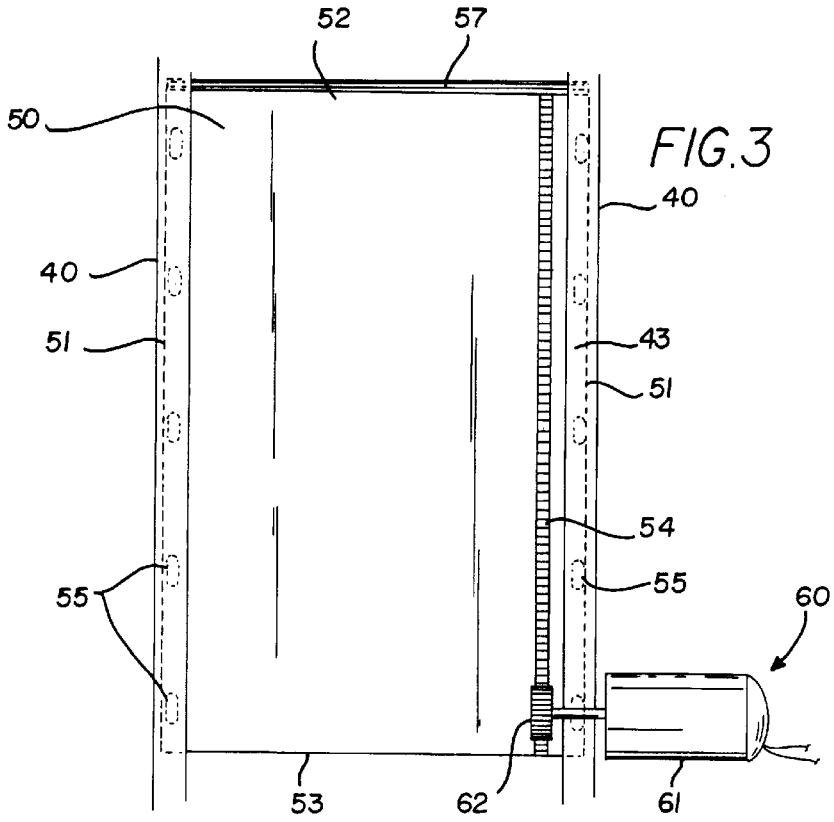
FIG. 3 is a schematic bottom view of the present invention.

Preferably, a drive means 60 selectively positions the panel members 50 between the closed and open positions. More preferably, as shown in FIG. 3, the drive means 60 comprises a drive motor 61 that is coupled to a lower surface of the roof structure 20 and is positioned adjacent the lower edge 25 of the roof structure 20. The panel member 50 has a toothed rail 54 that extends across a lower surface thereof. The drive motor 61 has a toothed gear 62 coupled to it. The toothed gear 62 of the motor engages the toothed rail 54 of the panel member 50.

Ideally, the drive means 60 is controlled by a controller 63. The controller 63 is in communication with the motor and has a rotary dial 64 coupled to it. The rotary dial 64 is positionable between a first position and a second position. The first position of the rotary dial 64 corresponds to the closed position of the panel member 50. The second position of the rotary dial 64 corresponding to the open position of the panel member 50. Positioning of the rotary dial 64 at a point between the first and second positions causes the panel member 50 to be positioned at a position between the open and closed positions.

Most ideally, the controller 63 limits the extent to which the panel member 50 moves towards the open position, much like the way a garage door operates, so that the panel member 50 doesn't slide out of the side rails 40. But the controllers 63 do permit the panel members 50 to be slid completely out of the side rails 40 so that they may be removed for cleaning and maintenance.

In an alternate embodiment, the drive means 60 could also comprise a pulley mechanism (not shown) operated by hand.

Figure 2:
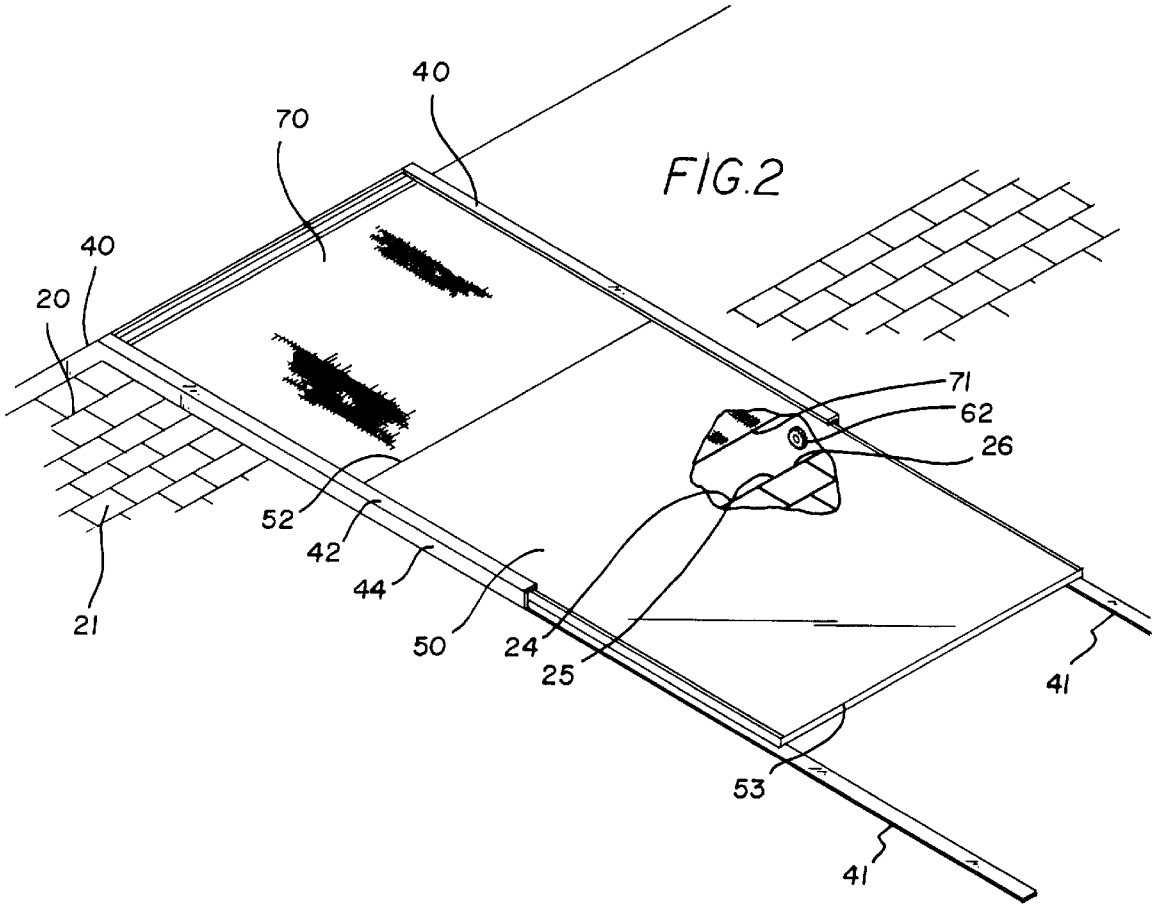
FIG. 2 is a schematic perspective view of the present invention from the top with a partial breakaway view.

Preferably, as seen in FIG. 3, each of the panel sides 51 of the panel members 50 has a row of uniformly spaced roller wheels 55 for permitting easier sliding of the panel member 50 along the side rails 40 and the roof structure 20. Ideally, as shown in FIG. 2, each of the side rails 40 has a pair of wheel tracks 41 that extend from ends thereof along the upper surface of the roof structure 20 towards and outer edge 23 thereof.

Also preferably, each of the side rails 40 has a top side 42, a bottom side 43, and a back side 44. Each of the top sides 42 of the side rails 40 has a rubber seal 45 coupled to it to help prevent the passage of water and air between the side rails 40 and the panel member 50. More preferably, each of the panel sides 51 of the panel member 50 has a rubber seal 56 coupled to it. The rubber seals 56 of the panel member 50 slidably abut the rubber seals 45 of the top sides 42 of the side rails 40 to help prevent the passage of water and air therebetween.

Figure 4:
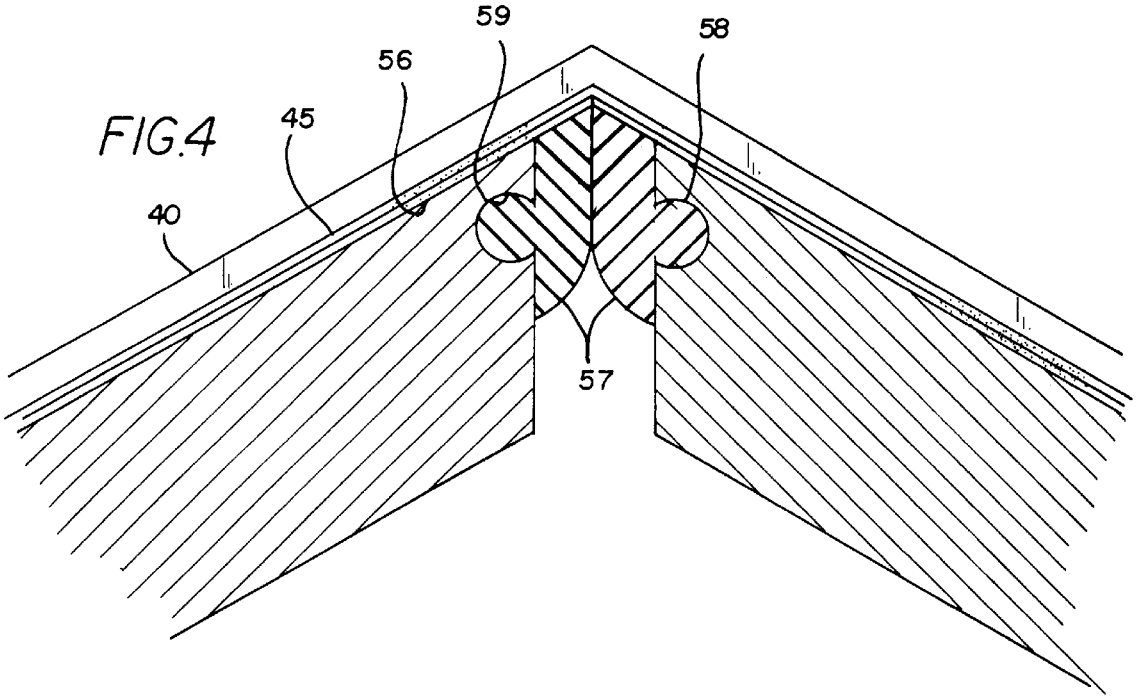
FIG. 4 is a schematic cross-sectional view of the present invention.
Figure 5:
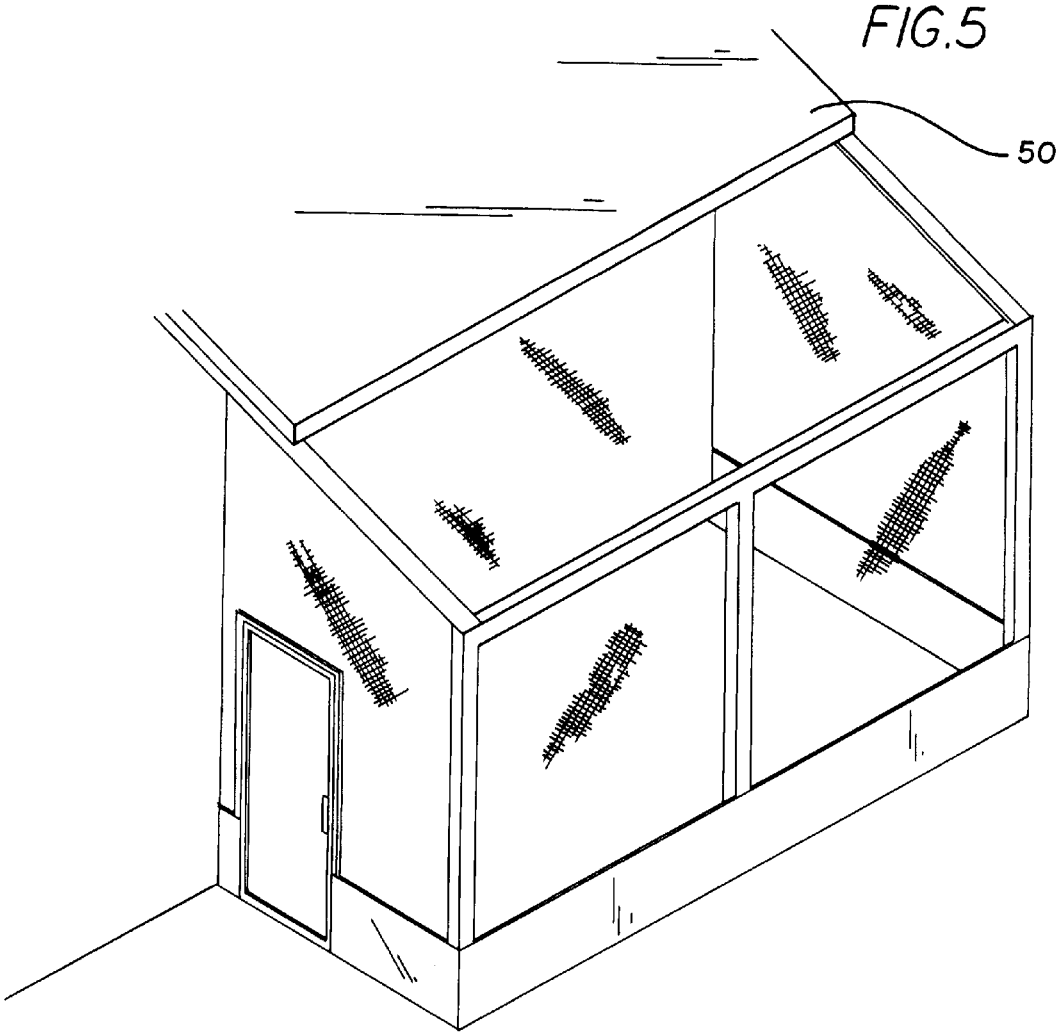
FIG. 5 is a schematic perspective view of an alternate embodiment the present invention.
Figure 6:
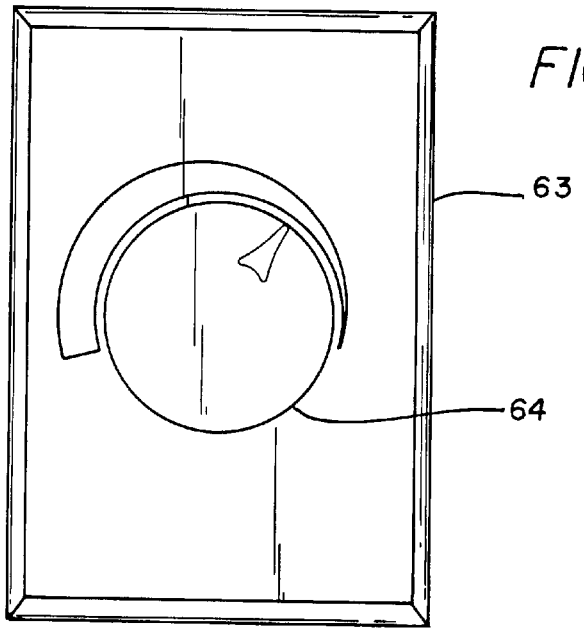
FIG. 6 is a schematic side view of a controller of the present invention.

Preferably, a shown in FIG. 4, a sealing member 57 is coupled to the upper end 52 of the panel member 50. The sealing member 57 forms a seal with the upper edge of the roof structure 20 when the panel member 50 is in the closed position. Ideally, each of the sealing members 57 has a lip 58 that extends therefrom along a length thereof. Each of the panel members 50 has a lip receiving channel 59 that extends into the upper ends 52 of the panel members 50 to receive the lips of the sealing members 57.

Also preferably, a screen 70 extends between the side edges (not shown) of the roof structure 20 across the opening 26. The screen 70 has opposed upper and lower screen ends 71 that extend between the side edges (not shown). As shown in FIG. 2, the lower screen end 71 is spaced apart from the lower edge 25 of the roof structure 20 so that the screen 70 doesn't get caught in the toothed gear 62 of the motor. An upper end 52 of the panel member 50 covers a portion of the lower screen end 71 when the panel member 50 is in the open position.

In an alternate embodiment, the roof structure 20 has a pair of roof portions 21 that are oriented at an angle to each other. Each of the roof portions 21 has an inner edge 22 and an outer edge 23. The roof portions 21 are coupled together along the inner edges 22 thereof. The roof structure 20 has a generally rectangular opening 26 that is formed by opposing notches 24 in the roof portions 21 that extend from the inner edges 22 of the roof portions 21 towards the outer edges 23 of the roof portions 21. Each of the notches 24 of the roof portions 21 has a pair of opposite side edges (not shown) and a lower edge 25 defining the opening 26.

A pair of opposed side rails 40 are coupled to an upper surface of the roof structure 20 and extend along the side edges (not shown) adjacent the opening 26 of the roof structure 20. Each of the side rails 40 has a generally U-shaped transverse cross-section.

A pair of panel members 50 each have a pair of opposed panel sides 51, an upper end 52 and a lower end 53. Each of the panel members 50 is slidably disposed between the side rails 40 and is positionable between a closed position and an open position. The panel members 50 substantially close the opening 26 of the roof structure 20 when in the closed position. The opening 26 of the roof structure 20 is substantially open when the panel members 50 are in the closed position.

A drive means 60 permits selective positioning of the panel members 50 between the closed and open positions. As shown in FIG. 3, the drive means 60 comprises a pair of drive motors 61 that are coupled to lower surfaces of the roof portions 21 and are positioned adjacent the lower edges 25 of the roof structure 20. Each of the panel members 50 has a toothed rail 54 that extends across a lower surface thereof. Each of the drive motors 61 has a toothed gear 62 coupled to it. The toothed gears 62 of the motors engage the toothed rails 54 of the panel members 50. Again, the drive means could also comprise a pulley mechanism (not shown).

The drive means 60 is controlled by a pair of controllers 63. One of the controllers 63 is in communication with one of the motors. Another of the controllers 63 is coupled to another of the motors. Each of the controllers 63 operates independently of the other to permit independent opening 26 and closing of each of the panel members 50 without regard to the positioning of the other.

Each of the controllers 63 has a rotary dial 64 coupled to it, which is positionable between a first position and a second position. The first position of the rotary dials 64 corresponds to the closed position of the panel members 50 while the second position of the rotary dials 64 corresponds to the open position of the panel members 50. Positioning of one of the rotary dials 64 at a point between the first and second positions causes the respective panel member 50 to be positioned at a position between the open and closed positions. The controllers 63 limit the extent to which the panel members 50 move towards the open position so that the panel members 50 don't slide out of the side rails 40, but the controllers 63 do permit the panel members 50 to be slid completely out of the side rails 40 so that they may be removed for cleaning and maintenance.

Each of the panel sides 51 of each of the panel members 50 has a row of uniformly spaced roller wheels 55 that permit easier sliding of the panel members 50 along the side rails 40 and the roof portions 21. As shown in FIG. 2, each of the side rails 40 having a pair of wheel tracks 41 being extended from opposite ends thereof along the upper surface of the associated roof portion 21 towards the outer edge 23 thereof.

Each of the side rails 40 has a top side 42, a bottom side 43, and a back side 44. Each of the top sides 42 of the rails 40 has a rubber seal 45 coupled to it, and each of the panel sides 51 of each of the panel members 50 has a rubber seal 56 coupled to it. The rubber seals 56 of the panel members 50 slidably abut the rubber seals 45 of the top sides 42 of the side rails 40 to help prevent the passage of the water and air therebetween.

As shown in FIG. 4, a pair of sealing members 57 are coupled to the upper ends 52 of the panel members 50. The sealing members 57 form a seal with each other when the panel members 50 are in the closed position. Each of the sealing members 57 has a lip 58 that extends therefrom along a length thereof. Each of the panel members 50 has a lip receiving channel 59 that extends into the upper ends 52 of the panel members 50 for receiving the lips of the sealing members 57.

A screen 70 extends between the side edges (not shown) of the roof portions 21 across the opening 26. The screen 70 has opposed screen ends 71 that extend between the side edges (not shown). As shown in FIG. 2, the screen ends 71 are spaced apart from the lower edges 25 of the roof structure 20 that the screen 70 doesn't get caught in the toothed gears 62 of the motors. Each of the upper ends 52 of the panel members 50 covers a portion of the screen ends 71 when the panel members 50 are in the open position so that there is no gap through which bugs could fly.

In use, the rotary dial 64 of the controller 63 or controllers 63 is turned between the first and second positions to position the panel member 50 or members in the desired position between the open and closed positions. When in the open position, air and sunlight may enter the opening 26 in the roof structure 20, while bugs are kept out by the screen 70.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to one encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A retractable roof panel system comprising:

a roof structure having a generally rectangular opening therein, and a pair of opposite side edges and upper and lower edges defining said opening;

a retractable roof panel comprising:

a pair of opposed side rails being coupled to an upper surface of said roof structure and extending along said side edges adjacent said opening of said roof structure;

a panel member having a pair of opposed panel sides, an upper end and a lower end, said panel member being slidably disposed between said side rails;

said panel member being positionable between a closed position and an open position, said panel member substantially closing said opening of said roof structure when in said closed position, said opening of said roof structure being substantially open when said panel member is in said open position;

a drive means for selectively positioning said panel members between said closed and open positions; and wherein said drive means is controlled by a controller, said controller being in communication with said motor, said controller having a rotary dial coupled thereto, said rotary dial being positionable between a first position and a second position, said first position of said rotary dial corresponding to said closed position of said panel member, said second position of said rotary dial corresponding to said open position of said panel member, wherein positioning of said rotary dial at a point between said first and second positions causes the panel member to be positioned at a position between said open and closed positions.

2. The retractable roof panel of claim 1, wherein said drive means comprises a drive motor being coupled to a lower surface of said roof structure and is positioned adjacent said lower edge of said roof structure, said panel member having a toothed rail extending across a lower surface thereof, said drive motor having a toothed gear being coupled thereto, said toothed gear of said motor engaging said toothed rail of said panel member.

3. The retractable roof panel of claim 1, wherein each of said panel sides of said panel member has a row of uniformly spaced roller wheels for permitting easier sliding of said panel member along said side rails and said roof structure.

4. The retractable roof panel of claim 3, wherein each of said side rails has a pair of wheel tracks being extended from ends thereof along said upper surface of the said roof structure towards an outer edge thereof.

5. The retractable roof panel of claim 1, wherein each of said side rails has a top side, a bottom side, and a back side, each of said top sides of said side rails having a rubber seal coupled thereto for helping prevent the passage of water and air between said side rails and said panel member.

6. The retractable roof panel of claim 5, wherein each of said panel sides of said panel member has a rubber seal coupled thereto, said rubber seals of said panel member slidably abutting said rubber seals of said top sides of said side rails for helping prevent the passage of water and air therebetween.

7. The retractable roof panel of claim 1, further comprising a sealing member being coupled to said upper end of said panel member, said sealing member forming a seal with the upper edge of said roof structure when said panel member is in said closed position.

8. The retractable roof panel of claim 7, wherein said sealing member has a lip being extended therefrom along a length thereof, said panel member having a lip receiving channel extending into said upper end of said panel member for receiving said lip of said sealing member.

9. The retractable roof panel of claim 1, further comprising a screen being extended between said side edges of said roof structure across said opening, said screen having opposed upper and lower screen ends extending between said side edges, said lower screen end being spaced apart from said lower edge of said roof structure wherein an upper end of said panel member covers a portion of said lower screen end when said panel member is in said open position.

10. A roof with retractable roof panel comprising, in combination:

a roof structure having a pair of roof portions being oriented at an angle to each other, each of said roof portions having an inner edge and an outer edge, said roof portions being coupled together along said inner edges thereof;

said roof structure having a generally rectangular opening being formed by opposing notches in said roof portions extending from said inner edges of said roof portions towards said outer edges of said roof portions, each of said notches of said roof portions having a pair of opposite side edges and a lower edge defining said opening;

a pair of opposed side rails being coupled to an upper surface of said roof structure and extending along said side edges adjacent said opening of said roof structure, each of said side rails having a generally U-shaped transverse cross-section;

a pair of panel members, each of said panel members having a pair of opposed panel sides, an upper end and a lower end, each of said panel members being slidably disposed between said side rails;

each of said panel members being positionable between a closed position and an open position, said panel members substantially closing said opening of said roof structure when in said closed position, said opening of said roof structure being substantially open when said panel members are in said open position;

a drive means for selectively positioning said panel members between said closed and open positions, said drive means comprising a pair of drive motors being coupled to lower surfaces of said roof portions and being positioned adjacent said lower edges of said roof structure, each of said panel members having a toothed rail extending across a lower surface thereof, each of said drive motors having a toothed gear being coupled thereto, said toothed gears of said motors engaging said toothed rails of said panel members;

said drive means being controlled by a pair of controllers, one of said controllers being in communication with one of said motors, another of said controllers being coupled to another of said motors, each of said controllers operating independently of the other;

each of said controllers having a rotary dial coupled thereto, said rotary dials being positionable between a first position and a second position, said first position of said rotary dials corresponding to said closed position of said panel members, said second position of said rotary dials corresponding to said open position of said panel members, wherein positioning of one of said rotary dials at a point between said first and second positions causes the respective panel member to be positioned at a position between said open and closed positions;

each of said panel sides of each of said panel members having a row of uniformly spaced roller wheels for permitting easier sliding of said panel member along said side rails and said roof portions;

each of said side rails having a pair of wheel tracks being extended from opposite ends thereof along said upper surface of the associated roof portion towards said outer edge thereof;

each of said side rail having a top side, a bottom side, and a back side, each of said top sides of said rails having a rubber seal coupled thereto, each of said panel sides of each of said panel members having a rubber seal coupled thereto, said rubber seals of said panel members slidably abutting said rubber seals of said top sides of said side rails for helping prevent the passage of water and air therebetween;

a pair of sealing members being coupled to said upper ends of said panel members, said sealing members forming a seal with each other when said panel members are in said closed position;

each of said sealing members having a lip being extended therefrom along a length thereof, each of said panel members having a lip receiving channel extending into said upper ends of said panel members for receiving said lips of said sealing members; and a screen being extended between said side edges of said roof portions across said opening, said screen having opposed screen ends extending between said side edges, said screen ends being spaced apart from said lower edges of said roof structure, wherein each of said upper ends of said panel members covers a portion of said screen ends when said panel members are in said open position.

11. A roof with retractable roof panel comprising:

a roof structure having a generally rectangular opening therein, and a pair of opposite side edges and upper and lower edges defining said opening;

a retractable roof panel comprising:

a pair of opposed side rails being coupled to an upper surface of said roof structure and extending along said side edges adjacent said opening of said roof structure;

a panel member having a pair of opposed panel sides, an upper end and a lower end, said panel member being slidably disposed between said side rails;

said panel members being positionable between a closed position and an open position, said panel member substantially closing said opening of said roof structure when in said closed position, said opening of said roof structure being substantially open when said panel members is in said open position; and wherein each of said side rails has a top side, a bottom side, and a back side, each of said top sides of said side rails having a rubber seal coupled thereto for helping prevent the passage of water and air between said side rails and said panel member.

12. The retractable roof panel of claim 11, wherein each of said panel sides of said panel member has a row of uniformly spaced roller wheels for permitting easier sliding of said panel member along said side rails and said roof structure.

13. The retractable roof panel of claim 12, wherein each of said side rails has a pair of wheel tracks being extended from ends thereof along said upper surface of the said roof structure towards an outer edge thereof.

14. The retractable roof panel of claim 11, wherein each of said panel sides of said panel member has a rubber seal coupled thereto, said rubber seals of said panel member slidably abutting said rubber seals of said top sides of said side rails for helping prevent the passage of water and air therebetween.

15. The retractable roof panel of claim 11, further comprising a screen being extended between said side edges of said roof structure across said opening, said screen having opposed upper and lower screen ends extending between said side edges, said lower screen end being spaced apart from said lower edge of said roof structure wherein an upper end of said panel member covers a portion of said lower screen end when said panel member is in said open position.

16. A roof with retractable roof panel comprising:

a roof structure having a generally rectangular opening therein, and a pair of opposite side edges and upper and lower edges defining said opening;

a retractable roof panel comprising:

a pair of opposed side rails being coupled to an upper surface of said roof structure and extending along said side edges adjacent said opening of said roof structure;

a panel member having a pair of opposed panel sides, an upper end and a lower end, said panel member being slidably disposed between said side rails;

said panel members being positionable between a closed position and an open position, said panel member substantially closing said opening of said roof structure when in said closed position, said opening of said roof structure being substantially open when said panel member is in said open position;

a sealing member being coupled to said upper end of said panel member, said sealing member forming a seal with the upper edge of said roof structure when said panel member is in said closed position; and wherein said sealing member has a lip being extended therefrom along a length thereof, said panel member having a lip receiving channel extending into said upper end of said panel member for receiving said lip of said sealing member.

17. The retractable roof panel of claim 16, wherein each of said panel sides of said panel member has a row of uniformly spaced roller wheels for permitting easier sliding of said panel member along said side rails and said roof structure.

18. The retractable roof panel of claim 17, wherein each of said side rails has a pair of wheel tracks being extended from ends thereof along said upper surface of the said roof structure towards an outer edge thereof.

19. The retractable roof panel of claim 18, further comprising a screen being extended between said side edges of said roof structure across said opening, said screen having opposed upper and lower screen ends extending between said side edges, said lower screen end being spaced apart from said lower edge of said roof structure wherein an upper end of said panel member covers a portion of said lower screen end when said panel member is in said open position.

* * * * *